US005987935A

United States Patent [19]

Uhlin

[11] Patent Number: 5,987,935

[45] Date of Patent: Nov. 23, 1999

[54] WASHING MACHINE

[75] Inventor: Göran Uhlin, Lagan, Sweden

[73] Assignee: Aktiebolget Electrolux, Stockholm, Sweden

[21] Appl. No.: 09/142,708

[22] PCT Filed: Jan. 14, 1998

[86] PCT No.: PCT/SE98/00050

§ 371 Date: Sep. 14, 1998

§ 102(e) Date: Sep. 14, 1998

[87] PCT Pub. No.: WO98/31865

PCT Pub. Date: Jul. 23, 1998

[30] Foreign Application Priority Data

Jan. 20, 1997 [SE] Sweden ..... 9700147

[51] Int. Cl.[6] ..... D06F 39/08

[52] U.S. Cl. ..... 68/207; 68/208

[58] Field of Search ..... 68/207, 208, 12.21

[56] References Cited

U.S. PATENT DOCUMENTS

| | | | |
|---|---|---|---|
| 2,443,816 | 6/1948 | Davis, Jr. | 68/208 X |
| 3,013,765 | 12/1961 | Buss | 68/208 X |
| 3,285,038 | 11/1966 | Wolverton | 68/208 X |
| 4,224,811 | 9/1980 | Yamashita | 68/208 X |
| 5,072,473 | 12/1991 | Thuruta et al. | 68/207 X |

*Primary Examiner*—Philip R. Coe

*Attorney, Agent, or Firm*—Pearne, Gordon, McCoy & Granger LLP

[57] ABSTRACT

A laundry washing machine comprises a tub (11) rotatably housing a wash drum (12) supporting laundry items, water supply means (13) for the supply of water to the tub (11), level sensing means (15, 16, 17) for sensing the liquid level in the tub (11) and liquid draining means (20, 32, 33) for draining off wash and rinse liquid from the tub (11) said liquid draining means including a bottom valve (20) with a valve housing (21) and a movable valve member (27) adapted to sealingly bear against an annular edge (26) in the valve housing (21). The level sensing means comprises a chamber (17) annularly surrounding said annular edge (26). The upper part of said chamber is adapted to communicated with a pressure sensor (15) and the lower part of said chamber is adapted to communicate with the interior of the tub via at least one channel (42) having a small cross section. An elastic, annular sealing means (39) is provided which is adapted to close the annular chamber (17), by means of the movable valve member (27), when the bottom valve (20) is closed.

18 Claims, 3 Drawing Sheets

WASHING MACHINE

Figure 1:
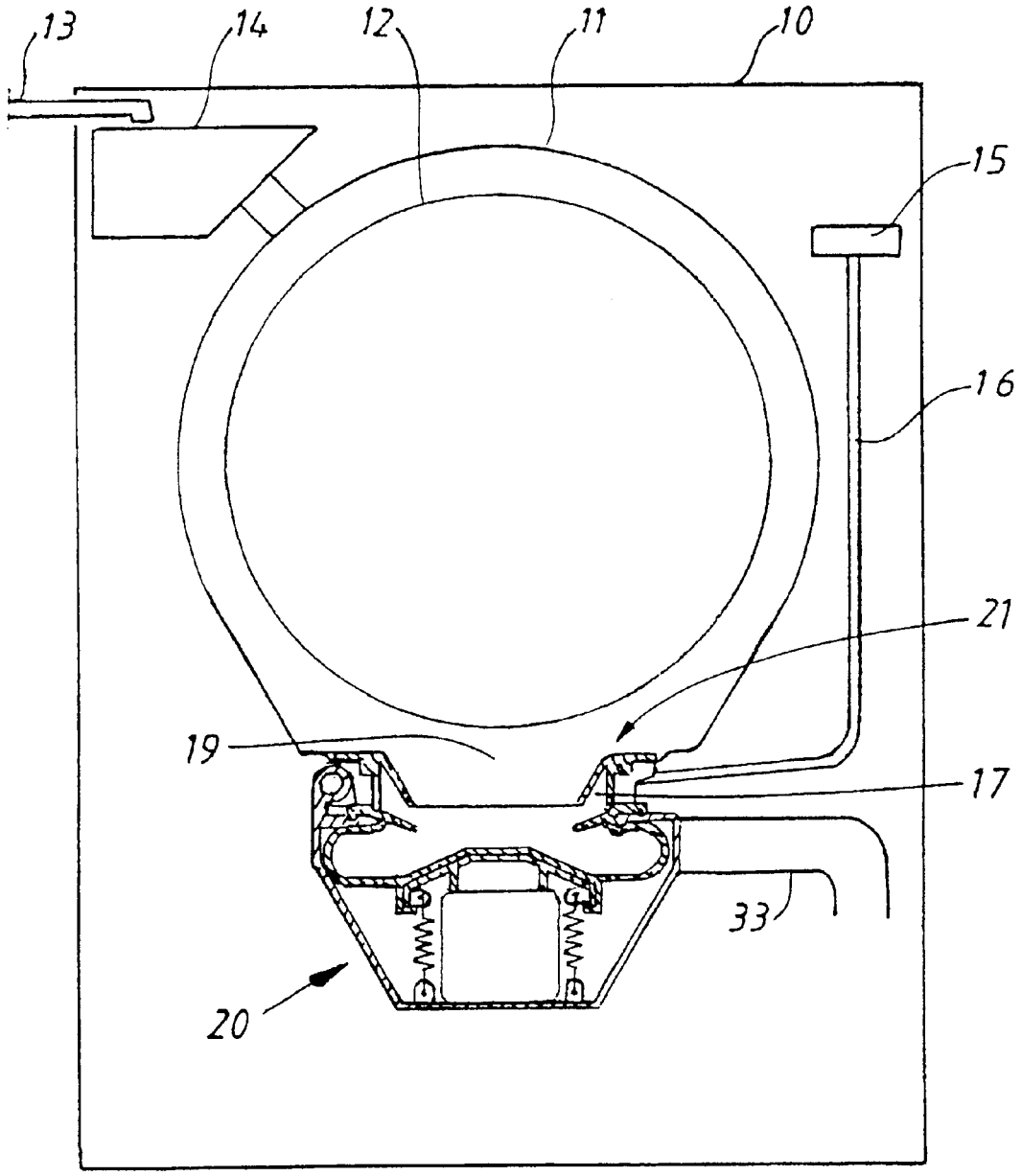

The present invention relates to a laundry washing machine, and more particularly a laundry washing machine equipped with a bottom valve for draining off wash and rinse liquid and having level sensing means for sensing of the liquid level in the machine.

In a laundry washing machine of the kind referred to present on the market the level sensing means comprises a pressure sensor, named pressostat, via a narrow conduit connected with an air volume enclosed in a chamber. The chamber, disposed in the bottom part of the washing machine, is connected to the interior of the tub such that the liquid column in the chamber reflects the liquid level in the machine.

In the machine referred to water is supplied from below via a channel connecting the outlet from the tub with the bottom valve. The chamber is disposed adjacent to said channel and, accordingly, the level sensing function is easily disturbed by the incoming water passing by. Moreover, the level sensing function can also be disturbed by liquid movements appearing during the normal operation of the machine.

In liquid level arrangements of the kind referred to the chamber must have a certain minimum height in order for the maximum liquid level to become safely detectable without the liquid reaching the area in the chamber where the conduit opens which leads to the pressure sensor. Otherwise, due to the fact that often the liquid is dirty soil particles could settle in that area completely putting the level sensing function out of order. Such a functional disorder can also appear due to a drip of water covering the entrance of the level sensing conduit.

Accordingly, the object of the invention is to remedy the drawbacks indicated above and to provide a laundry washing machine in which the level sensing function has become more reliable as a result of incoming water and liquid movements in the machine, when in operation, not noticably influencing on the level sensing function.

According to the preamble of claim 1 the invention relates to a laundry washing machine comprising a tub rotatably supporting a wash drum containing laundry items, water supply means for supplying water to the tub, level sensing means for sensing of the liquid level in the tub, and liquid draining means for draining off wash and rinse liquid from the tub, said liquid draining means including a bottom valve with a valve housing and a movable valve member adapted to sealingly bear on an annular edge in the valve housing.

The object indicated is achieved in the washing machine defined in claim 1 by the level sensing means comprising a chamber annularly surrounding the annular edge, the upper part of said chamber being adapted to communicate with a pressure sensor and the bottom part of said chamber being adapted to communicate with the interior of the tub via at least one channel of a narrow cross-section, an elastic annular sealing member being provided which is adapted to close the annular chamber, by means of the movable valve member, when the bottom valve is closed.

Preferred embodiments are indicated in the sub-claims.

Figure 2:
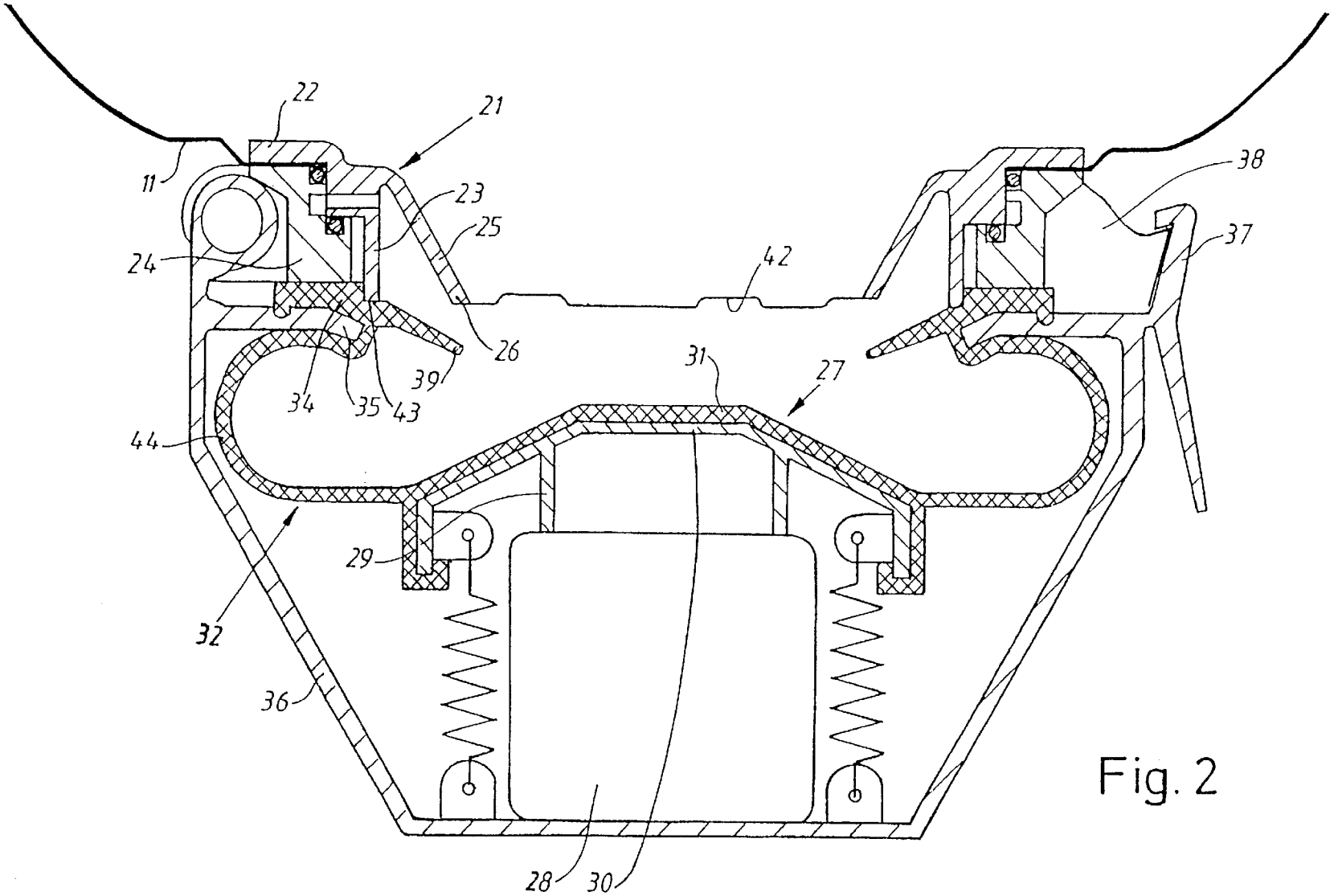
Figure 3:
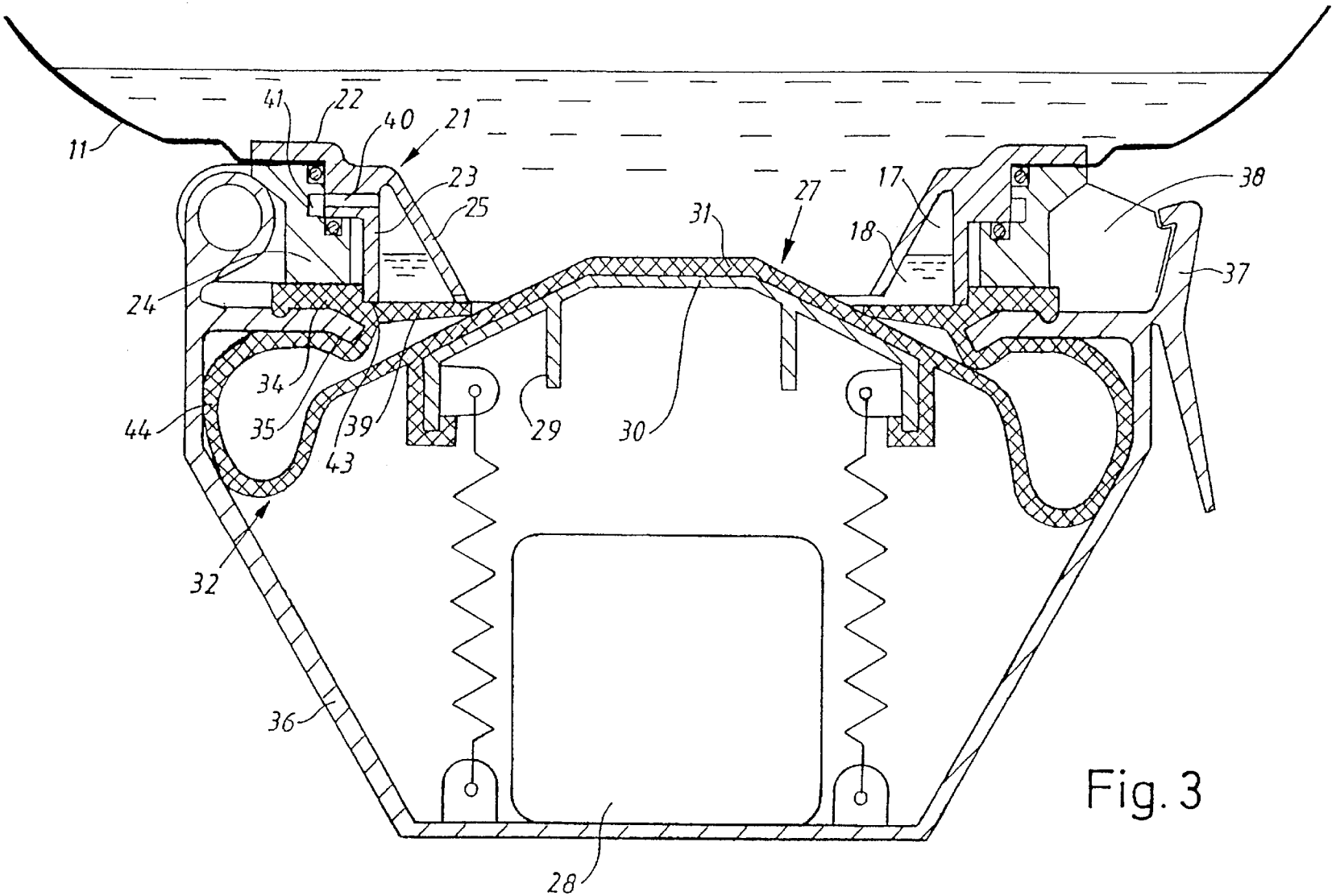

The invention will now be described in more detail in connection with an embodiment and with reference to the acompanying drawings, in which:

FIG. 1 schematically shows a laundry washing machine having a bottom valve and level sensing means in accordance with the invention;

FIG. 2 is a detail view of the bottom valve in open position and showing also adjacent parts of the washing machine and a level sensing chamber provided adjacent to the bottom valve, and FIG. 3 shows the detail view of FIG. 2, however, with the bottom valve in its closed position.

In FIG. 1 a standard laundry washing machine is shown having a cabinet 10 housing an outer drum or tub 11 serving as a container for wash liquid and at the same time enclosing a rotatably disposed inner drum 12 supporting the textile items to be washed and dewatered. Moreover, the machine is provided with water supplying means 13 adapted to supply water to the tub 11 via a detergent container 14 in order to supply, in this way, simultaneously with the water also detergent and the like to the tub 11.

In order to see to it that the level of liquid in the inner drum 12 takes a suitable value the machine is provided with a level sensing means in the form of a pressure sensor 15, often named pressostat, which, by means of a conduit 16 of a small cross-section is connected with the upper part of a chamber 17 (FIG. 3) which is also connected with the lower part of the tub 11 such that when the water rises in the tub a water column 18 is created in the chamber 17 thereby applying a pressure to the air volume enclosed thereabove in the chamber 17 and the conduit 16, said pressure being translated by the pressure sensor 15 into a measure of the liquid level in the machine.

For draining off wash and rinse liquid from the machine an opening 19 is provided in which a drain or bottom valve 20 is disposed. The bottom valve comprises a first part 21 which in a suitable way is mounted adjacent to the opening 19. In the embodiment the first part 21 is provided with a horizontal flange 22 which inside of the tub 11 extends beyond the edge of the opening 19. Moreover the part 21 has a sleeve-shaped part 23 extending downwardly through the opening 19 and onto the outer side of which a nut-like part 24 is pushed or screwed for the purpose of securing the part 21 in the opening 19. The part 21 also has a conical portion 25 the free edge of which forms the sealing edge 26 of the valve.

The bottom valve also includes a movable valve element 27 which, by means of a drive 28, can be brought to sealingly bear against the sealing edge 26. The drive can be a solenoid, an electric motor or a hydraulic device operated by the pressurized water supplied to the machine. In the example the drive 28 comprises a piston 29 equipped with a piston plate 30 secured to a wall 31 situated right opposite to the opening 19 and being part of a drainage hose 32, in a suitable way connected to a drainage pipe 33. The drainage hose 32 has an annular flange 34 forced over an edge 35 on a pivotably disposed mounting part 36 which supports the drive 28 and is provided with a snap-in fixing 37, 38 securing the mounting part 36 to the part 21 under simultaneous clamping of the flange 34 against the the nut-like part 24. The sleeve-formed part 23 is downwardly ended by an edge 43 and by means of the mounting of the flange 34 of the drainage hose 32, as described, said flange 34 will effect a sealing of the drainage hose 32 against the edge 43.

The level sensing chamber 17 is formed by the sleeve-shaped part 23, the conical portion 25 and a sealing lip 39 closing the chamber 17 from below when the valve is closed (FIG. 3). By means of suitable channels 40, 41 the upper part of the chamber communicates with the conduit 16 whereas the lower part of the chamber, via one or more cuts in the sealing edge 26, conmnunicates with the interior of the machine so that when the liquid level rises in the machine a liquid column 18 is also developing in the chamber 17 and in this way a pressure is applied to the air volume enclosed above the liquid column which can be detected by the pressure sensor 15. By cooperation between the vertical wall formed by the sleeve-shaped part 23 and the slant wall formed by the conical portion 25 the chamber is given a triangular cross-section resulting in that as the liquid rises in the chamber the rate of change of pressure becomes increasingly higher for a given change of level. In this way it is assured that the level will never rise to the uppermost part of the chamber so that water drips, dirt, detergent residues and the like have an opportunity of blocking the channels 40 and 41 and the inlet of the conduit 16. Such blocking may result in a complete ruining of the level sensing function. Of course, the function of differential pressure increase can be achieved by a cross-section of a different form as far as the shape involves narrowing of the chamber in an upward direction.

As a result of the shape of the draining hose 32 shown in the drawings bellows-shaped edge portions 44 are formed permitting that the hose, which has been made of elastic material, suitably rubber, can absorb the movements developed when the valve element 27 moves to and from the sealing edge 26. In FIG. 3 the valve element 27 is shown in a position in which it sealingly bears on the sealing edge 26 and at the same time presses the sealing lip 39 upwards in order to close the chamber 17. In FIG. 2 the valve element 27 is shown in a lower position wherein the valve is open and at the same time the sealing lip 39 has taken a position in which it is directed downwards at an angle forming a deflecting surface for liquid flowing out. The intention is that liquid be led into the chamber to rinse it clean from detergent residues and dirt possibly introduced in the chamber during the wash process. This has proved to be of importance in maintaining a safe level sensing function for a long period of time.

In connection with laundry washing machines it has also appeared that normal movements of the liquid in the washing machine, when operating, result in splashes which can disturbe the level sensing function causing it to become unreliable. By giving the channels connecting the chamber 17 with the interior of the machine the shape of narrow cuts 42 in the sealing edge 26 and distribute these cuts along the periphery of said edge the disturbing effect of liquid movements are reduced to a minimum.

I claim:

1. Laundry washing machine with a tub (11) rotatably housing a wash drum (12) supporting laundry items, water supply means (13) for supplying water to the tub (11), level sensing means (15,16,17) for sensing liquid level in the tub (11), and liquid draining means (20,32,33) for draining off wash and rinse liquid from the tub (11), said liquid draining means including a bottom valve (20) with a valve housing (21) and a movable valve member (27) adapted to sealingly bear against an annular edge (26) in the valve housing (21), wherein the level sensing means comprises a chamber (17) annularly surrounding said annular edge (26), an upper part of said chamber being adapted to communicate with a pressure sensor (15) and a lower part of said chamber being adapted to communicate with an interior of the tub via at least one channel (42) having a small cross-section, an elastic, annular sealing means (39) being provided which is adapted to close the annular chamber (17), by means of the movable valve member (27), when the bottom valve (20) is closed.

2. Machine according to claim 1, wherein the annular chamber (17) has a shape which narrows in an upward direction.

3. Machine according to claim 2, wherein the annular chamber (17) has a triangular cross-section.

4. Machine according to claim 3, wherein the annular edge (26) has at least one cut (42) forming with the annular sealing means (39), when the valve is closed, a gap via which the annular chamber (17) communicates with the interior of the tub.

5. Machine according to claim 4, wherein several gaps (42) are evenly distributed along the periphery of the annular edge (26).

6. Machine according to claim 2, wherein the annular edge (26) has at least one cut (42) forming with the annular sealing means (39), when the valve is closed, a gap via which the annular chamber (17) communicates with the interior of the tub.

7. Machine according to claim 6, wherein several gaps (42) are evenly distributed along the periphery of the annular edge (26).

8. Machine according to claim 2, wherein the movable valve member (27) is formed by part of a draining hose (32), said valve member in the area right opposite to the opening (19) in the valve housing (21), defined by the annular edge (26), being connected to a valve plate (30) disposed at the outside of the draining hose, said valve plate being connected with a valve rod (29) adapted to move vertically to and from the annular edge (26), said annular sealing means (39) being formed as part of the draining hose (32).

9. Machine according to claim 8, wherein the annular sealing means (39) is formed by a sealing lip extending from the draining hose and directed so as to form a deflecting surface when the valve is open, said surface acting to introduce into the annular chamber (17) part of the drain water rushing out for the purpose of flushing it clean.

10. Machine according to claim 9, wherein the annular chamber (17) is delimited by two walls (23,25) one of which (25) has a funnel shape and ends with the annular edge (26) whereas the other wall (23) extends vertically and ends with a second edge (43), situated mainly in the same plane as the annular edge (26), the draining hose (32) being provided with an annular mounting portion (34) disposed right opposite to the sealing lip (39) and directed outwards, said mounting portion being mounted so as to permanently seal against the second edge (43).

11. Machine according to claim 1, wherein the annular edge (26) has at least one cut (42) forming with the annular sealing means (39), when the valve is closed, a gap via which the annular chamber (17) communicates with the interior of the tub.

12. Machine according to claim 11, wherein several gaps (42) are evenly distributed along the periphery of the annular edge (26).

13. Machine according to claim 11, wherein the movable valve member (27) is formed by part of a draining hose (32), said valve member in the area right opposite to the opening (19) in the valve housing (21), defined by the annular edge (26), being connected to a valve plate (30) disposed at the outside of the draining hose, said valve plate being connected with a valve rod (29) adapted to move vertically to and from the annular edge (26), said annular sealing means (39) being formed as part of the draining hose (32).

14. Machine according to claim 13, wherein the annular sealing means (39) is formed by a sealing lip extending from the draining hose and directed so as to form a deflecting surface when the valve is open, said surface acting to introduce into the annular chamber (17) part of the drain water rushing out for the purpose of flushing it clean.

15. Machine according to claim 14, wherein the annular chamber (17) is delimited by two walls (23,25) one of which (25) has a funnel shape and ends with the annular edge (26)

whereas the other wall (23) extends vertically and ends with a second edge (43), situated mainly in the same plane as the annular edge (26), the draining hose (32) being provided with an annular mounting portion (34) disposed right opposite to the sealing lip (39) and directed outwards, said mounting portion being mounted so as to permanently seal against the second edge (43).

16. Machine according to claim 1 wherein the movable valve member (27) is formed by part of a draining hose (32), said valve member in the area right opposite to the opening (19) in the valve housing (21), defined by the annular edge (26), being connected to a valve plate (30) disposed at the outside of the draining hose, said valve plate being connected with a valve rod (29) adapted to move vertically to and from the annular edge (26), said annular sealing means (39) being formed as part of the draining hose (32).

17. Machine according to claim 16 wherein the annular sealing means (39) is formed by a sealing lip extending from the draining hose and directed so as to form a deflecting surface when the valve is open, said surface acting to introduce into the annular chamber (17) part of the drain water rushing out for the purpose of flushing it clean.

18. Machine according to claim 17, wherein the annular chamber (17) is delimited by two walls (23,25) one of which (25) has a funnel shape and ends with the annular edge (26) whereas the other wall (23) extends vertically and ends with a second edge (43), situated mainly in the same plane as the annular edge (26), the draining hose (32) being provided with an annular mounting portion (34) disposed right opposite to the sealing lip (39) and directed outwards, said mounting portion being mounted so as to permanently seal against the second edge (43).

* * * * *